US007066569B2

(12) United States Patent
Ishizuka et al.

(10) Patent No.: US 7,066,569 B2
(45) Date of Patent: Jun. 27, 2006

(54) RECORDING APPARATUS

(75) Inventors: Haruo Ishizuka, Ichikawa (JP); Katsumi Obana, Funabashi (JP); Shigeyuki Sugiyama, Hiratsuka (JP); Takayuki Nishinohara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 10/764,546

(22) Filed: Jan. 27, 2004

(65) Prior Publication Data

US 2004/0183857 A1 Sep. 23, 2004

(30) Foreign Application Priority Data

Jan. 29, 2003 (JP) ..... 2003-019863

(51) Int. Cl.
*B41J 23/00* (2006.01)

(52) U.S. Cl. ..... 347/37; 347/49; 347/108

(58) Field of Classification Search ..... 347/37, 347/108, 49

See application file for complete search history.

(56) References Cited

FOREIGN PATENT DOCUMENTS

| | | | |
|---|---|---|---|
| JP | 06270491 A | * | 9/1994 |
| JP | 08207392 A | * | 8/1996 |
| JP | 2000-127446 | | 5/2000 |

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

The present invention relates to a recording apparatus comprising a carriage provided reciprocally movably with a recording head unit placed thereon, a switchable cover for covering an opening portion for taking out the recording head unit from the apparatus at the time the carriage is stopped at a second stopping position different from a first stopping position provided at one end of the reciprocal movement range, and a release lever provided movably to a position for fixing the recording head unit on the carriage or releasing the same therefrom. The release lever is moved to a position for fixing the recording head unit on the carriage in the case the carriage is moved with the release lever disposed at a position for releasing the recording head unit from the carriage.

10 Claims, 11 Drawing Sheets

(a)

(b)

RECORDING APPARATUS

FIELD OF THE INVENTION

The present invention relates to a recording apparatus having the function of recording on a recording medium according to image information, such as a printer, a copying machine, and a facsimile device.

DESCRIPTION OF RELATED ART

Conventionally, as a recording section of the printer, the copying machine, and the facsimile device, there are those of the serial recording method having a carriage reciprocally movable along the main scanning direction, for recording while moving a recording medium in the sub scanning direction.

According to the recording section, there is one capable of detaching a recording head unit from the carriage without disassembling the apparatus in the case replacement of the recording head portion is required due to breakdown, or the like, such as the ink jet recording apparatus disclosed in Japanese Patent Application Laid Open (JP-A) No. 2000-127446.

In this form of the recording section, a release lever for fixing or releasing the recording head unit on the carriage is provided in the carriage.

By setting the recording head unit on the carriage and moving the release lever to a predetermined position, the electric contact on the carriage and the electric contact on the recording head are connected so that an input image signal can be transmitted to each recording head disposed on the recording head unit.

The above-mentioned release lever in general is operated from an opening portion with a cover provided in the recording section opened.

In order to enable the operation, the recording section has a detecting section for detecting the cover opening operation by an operator so that the carriage is moved to a position capable of allowing the operator to operate the release lever at the time the operator opens the cover for detecting the head unit mounting operation by the connection of the above-mentioned contacts.

Among the above-mentioned release levers, there are those projecting from the opening portion toward outside of the apparatus at the time of being disposed at a position for releasing the recording head unit in order to ensure the operationality at the time of releasing the recording head unit.

Moreover, there are those levers entering into the standby state after being mechanically locked after moving the carriage to a predetermined position by the software control in the case there is no operation for a predetermined time so as not to move the carriage even in the case the power source is cut off in the standby state or the apparatus is moved in order to prevent an adverse effect to the apparatus due to the drastic movement of the carriage by the vibration or the impact at the time of moving the apparatus.

According to the recording apparatus having the above-mentioned structure, in the case the cover is opened and the release lever is left at a position for releasing the recording head unit, if the carriage is moved, since the release lever is contacted with the opening portion so as to limit the carriage movement, the carriage may not be moved to the standby position.

Furthermore, in the case the apparatus is moved with the cover closed after turning off the power source by the operator in this state, it is the movement in a state without having the carriage locked that can adversely affect the apparatus due to the large movement of the carriage. This problem can hardly be improved even in the case a sensor for detecting the position of the release lever is provided.

SUMMARY OF THE INVENTION

In view of the conventional problems, the present invention can provide a recording apparatus capable of preventing the problem of having the carriage stopped at an optional position at the time of moving the carriage by enabling the carriage to move to the standby position in a locked state even in the case the apparatus is left in a state with the cover opened and the release lever disposed at a position for releasing the recording head unit.

An aspect of the present invention is directed to a recording apparatus comprising a carriage provided reciprocally movably with recording means placed thereon, a switchable cover member for covering an opening portion for taking out the recording means from the apparatus at the time the carriage is stopped at a second stopping position different from a first stopping position provided at one end of the reciprocal movement range, and a lever member provided movably to a position for fixing the recording means on the carriage or releasing the same therefrom, wherein the lever member is moved to a position for fixing the recording means on the carriage in the case the carriage is moved with the lever member disposed at a position for releasing the recording means from the carriage.

As heretofore explained, according to the present invention, even in the case the apparatus is left with the cover member opened and the lever member disposed at a position for releasing the recording means, the carriage can be moved to the standby position so as to be in the locked state so that a recording apparatus hardly generating a problem at the time of movement can be provided.

DETAILED DESCRIPTION OF PREFERRED EMBODIMENTS

Hereinafter, with reference to the drawings, preferable embodiments of the present invention will be explained in detail. However, the size of the constituent parts, the material, the shape, and the relative positions thereof disclosed in the embodiments herebelow can be changed optionally according to the configuration of the apparatus to use the present invention, and various kinds of the conditions, and thus the scope of the present invention is not limited thereto unless otherwise specified.

First Embodiment

Figure 1:
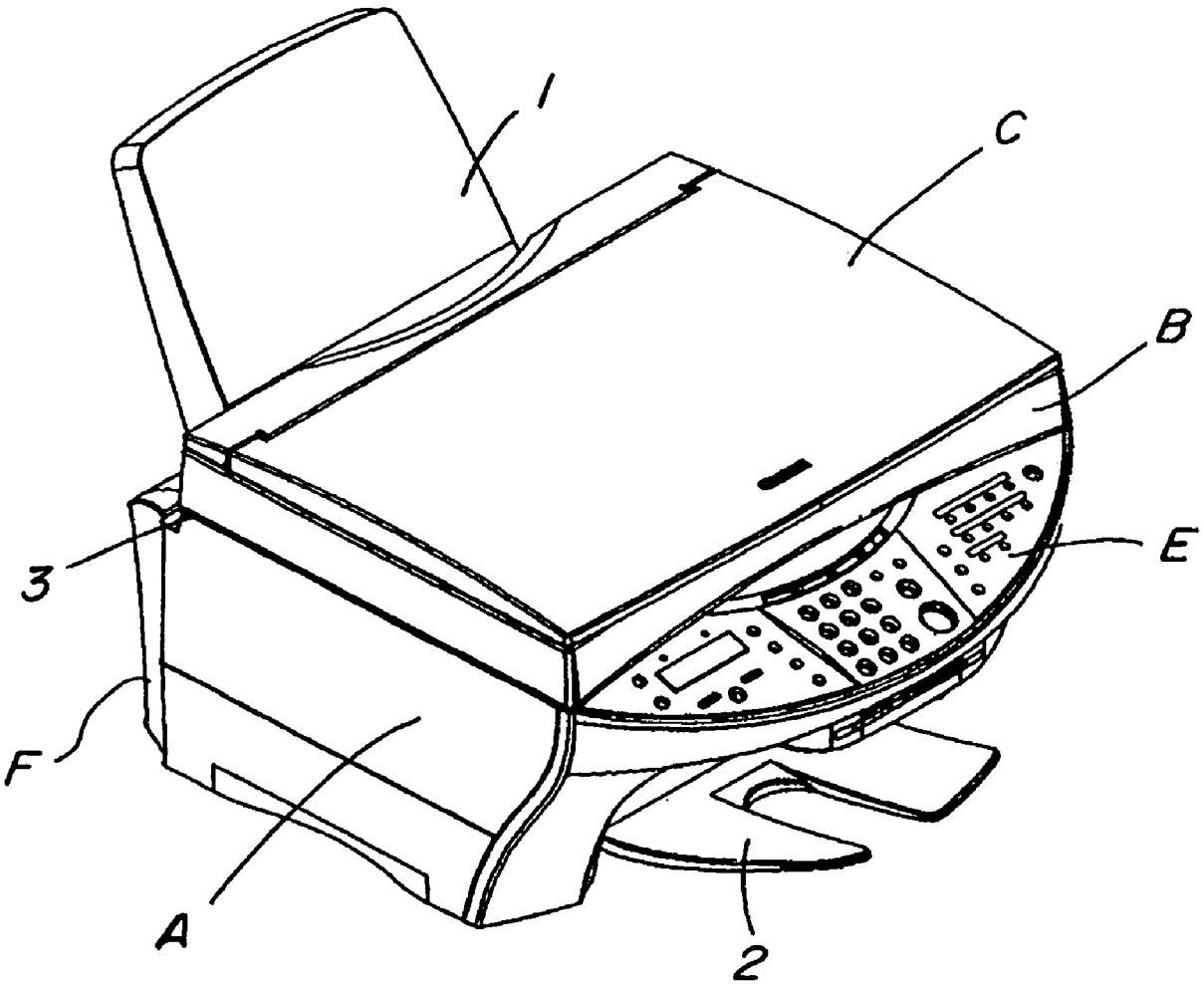
FIG. 1 is an entire perspective view showing a first embodiment of a recording apparatus of the present invention.
Figure 2:
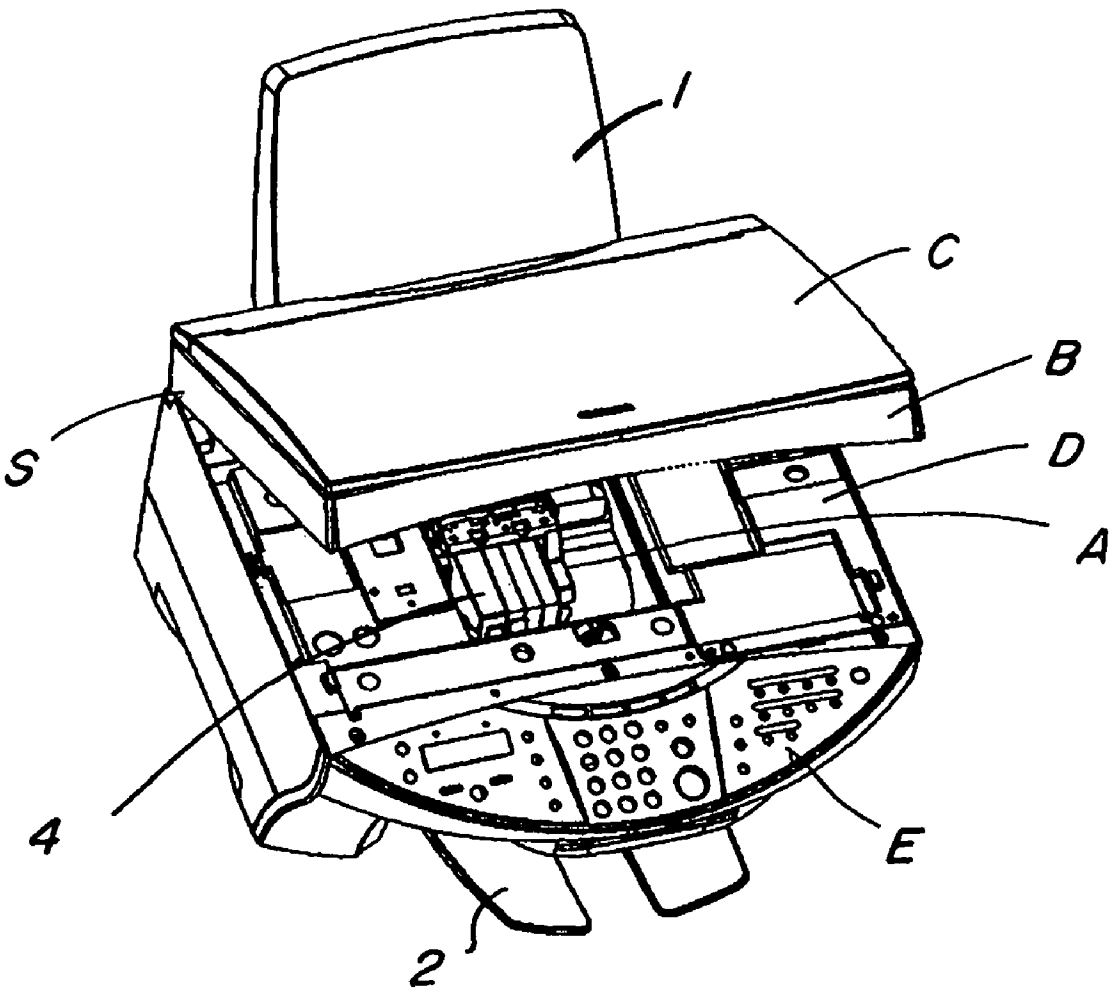
FIG. 2 is an entire perspective view showing a state with a scanner unit opened in the recording apparatus of the present invention.

Hereinafter, with reference to the drawings, an embodiment of the present invention will be explained. FIGS. 1 and 2 are schematic perspective views showing the embodiment of an image recording apparatus of the present invention.

{Entire Configuration of the Apparatus}

In the figures, reference A is a recording section, such as an ink jet recording section, B is a reading section for optically reading an original, C is a pressure plate for pressing an original placed on the reading section B, or the like, D is an electric accessory portion with a controlling section for controlling the entire apparatus and a connecting section for connecting data from a personal computer, or the like, provided at one part, E is an operating portion provided with a display and an operation key, and F is an apparatus power source portion.

In the figures, first the flow of a recording medium (hereinafter referred to as a recording paper) will be explained schematically. In this embodiment, ordinary regular sized cut papers are used, and they are stored in plural number in an auto sheet feeder. The auto sheet feeder 1 can guide the side surface of the recording papers according to the recording paper size by an unshown slider.

First, the recording papers stored and stacked on the auto sheet feeder 1 are separated and fed by only one sheet at a time by an unshown feeding roller and an unshown separating pad. Thereafter, they are pinched and fed to the recording section A.

The recording section A for executing a recording operation by an unshown recording head has an unshown discharging roller disposed on the downstream of the recording head for feeding a recorded recording paper to the apparatus downstream side, and an unshown spur disposed on the opposite side of the discharging roller, made of a material that prevents ink transfer even in the case of contacting with the recording surface of the recording paper.

The recording paper fed by the discharging roller and the spur is discharged onto a recording paper discharging tray 2 provided in the front portion of the apparatus main body.

{Reading Section}

Next, a flat bed scanner as the image reading section will be explained. An unshown close contact type image sensor (reading means) is supported by an unshown carriage movably along the sub scanning direction. The carriage is moved by an unshown timing belt driven by an unshown motor. The image sensor, comprising an unshown light source, a lens and a photoelectric converting element, is moved while keeping a constant distance with respect to the rear surface of a contact glass (not shown) as an original placing base. The read image is sent electrically to a main body image processing section (controlling section) by a flexible cable, or the like.

The reading section B, having a rotation center 3 toward the rear of the apparatus, is provided rotatably. By rotating the reading section B to the apparatus rear side, a space needed for replacement of the recording head and replacement of the ink tank 4 can be released.

{Recording Section}

Next, the configuration of the recording section A of this embodiment will be explained. The recording head used in this embodiment ejects an ink from an ejection opening at the nozzle top end by the pressure of film boiling generated in the ink by the heat generation of an electrothermal converting element provided in the nozzle.

{Electric Accessory Portion}

Next, the configuration of the electric accessory portion D of this embodiment will be explained in detail. The electric accessory portion D has a system control substrate for controlling mainly the system of the entire apparatus, a printer control substrate for controlling mainly the recording system, an operation control substrate mounting keys of the operation panel and the LED, or the like. Among these elements, the operation control substrate is disposed as the operating portion E obliquely on the apparatus front surface from the viewpoint of the apparatus operativity. As shown in FIG. 1, the system control substrate is disposed below the reading section B, and thereby the cables linking the electric accessory substrates can be made shorter and the apparatus installation area can be made smaller. The electric accessory portion D is supplied power by a power source unit provided in the power source portion F for supplying the power source to the apparatus.

Figure 3:
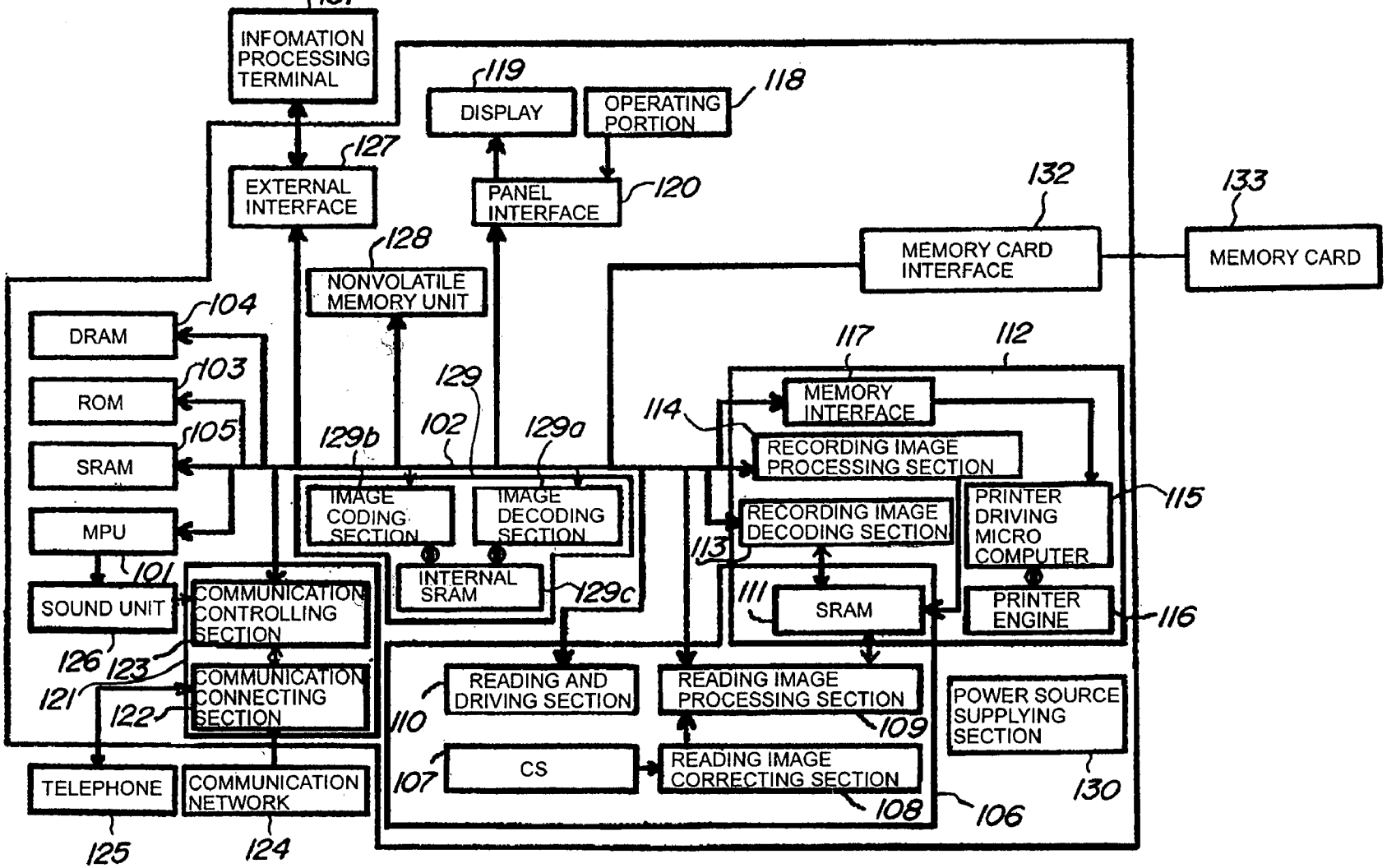
FIG. 3 is a block diagram of a control configuration.

Next, the control configuration of the facsimile device will be explained with reference to the block diagram of FIG. 3. In FIG. 3, the reference numeral 101 is a microprocessor unit (MPU) for controlling the entire apparatus via a system bus 102. The reference numeral 103 is a ROM storing a program code, initial value data, table data, or the like for the operation of the MPU 101. The reference numeral 104 is a DRAM to be used for the image buffer, the image memory, or the like, used as a buffer for temporarily storing the data at the time of transmitting or receiving with respect to an image processing terminal 131. Moreover, it is used also as a memory for accumulating the image data received via a communicating section 121, the image data read out by the reading section 106, and the image data transmitted from the information processing terminal 131 as a file. The reference numeral 105 is an SRAM used for the user registration data area, the work area, or the like. The DRAM 104 and the SRAM 105 are protected from unexpected trouble, such as black out, or the like, each by a battery back up.

The reference numeral 106 is a reading section (the reading section B shown in FIG. 1), having a contact sensor (CS) 107, a reading image correcting section 108, a reading image processing section 109, a reading and driving section 110, an SRAM 111, or the like, for driving the contact sensor by driving the reading and driving section 110, and optically reading by the CS 107 for converting to an electric image signal. The shading correction, or the like, is executed for the signal by the reading image correcting section 108, and furthermore, the image process is executed by the reading image processing section 109 for outputting highly sophisticated image data. The SRAM 111 is used as a buffer at the time of executing the image process.

The reference numeral 112 is an ink jet recording section (the recording section A shown in FIG. 1), having the SRAM 111, a recording image decoding section 113, a recording image processing section 114, a printer controlling microcomputer 115, a printer engine 116, a recording interface 117, or the like. The recording image decoding section 113 converts image data of the LAN length system to raw image data. The recording image processing section 114 applies to the raw image data image processing such as resolution conversion, image variable power, smoothing, density correction, or the like for converting the same to highly sophisticated image data. The SRAM 111 is used as a buffer at the time of the data conversion. The printer controlling microcomputer 115 has a recording controlling MPU for controlling the operations of the ink jet recording section 112, a ROM for describing various instructions for executing the recording control, means for reading out the instructions from the ROM, processing means for processing the read out instructions, a RAM capable of inputting the information needed by the processing means, outputting means for outputting a signal produced by the processing means, or the like, and thereby the input and output of the signal is executed for the recording control of the printer engine 116. The recording interface 117 is an interface for cooperation between the printer controlling microcomputer 115 and the MPU 101.

The reference numeral 118 is an operating portion, having various key switches such as ten numeral keys, or the like, for commanding the operations of the apparatus and inputting various kinds of information. The reference numeral 119 is a display, having an LCD, an LED, or the like for displaying the state of the apparatus, or the like. The reference numeral 120 is a panel interface, for cooperation between the MPU 101, the operating portion 118 and the display 119.

The reference numeral 121 is a communicating section having a communication connecting section 122, such as a line connecting unit, and a communication controlling section 123, such as a MODEM, for executing the line control. The reference numeral 124 is a communication network, and the reference numeral 125 is a telephone.

The reference numeral 126 is a sound unit, having a speaker, or the like, for notifying the various kinds of the states to the apparatus user by sounds.

The reference numeral 127 is an external interface, for transmitting and receiving data between the MPU 101, or the like, and the information processing terminal 131 for controlling the apparatus from the information processing terminal 131.

The reference numeral 128 is a nonvolatile memory unit, such as a large capacity nonvolatile memory used for storing the image information, or the like without the risk of erasing the information even in the case the power source is switched off. The nonvolatile memory unit has a flash memory, a hard disc, a RAM with a battery back up, or the like.

The reference numeral 129 is an image coding/decoding section for coding and decoding image data, and having an image decoding section 129*a*, an image coding section 129*b*, and an internal SRAM 129*c*.

The reference numeral 130 is a power source supplying section for supplying the power source to this apparatus. The reference numeral 131 is an information processing terminal such as a computer to be connected with the outside.

The reference numeral 132 is a memory card interface for communicating with a detachable memory card 133 storing a flash memory, or the like.

{Operation}

Each operation in this embodiment will be explained, including the copying operation, the facsimile receiving operation, the printer operation, and the memory card operation.

(Copying Operation)

The image information of the original read by the CS 107 of the reading section 106, with the processing such as the shading correction applied by the reading image correcting section 108 and further with the binary and image converting processing applied by the reading image processing section 109, is input to the image coding section 129*b* of the image coding/decoding section 129. The input image data are developed in the internal SRAM 129*c*, compression coded by the image coding section 129*b*, and accumulated in the DRAM 104. At the same time, the administration information of the image data is stored in the SRAM 105. The image coding data accumulated in the DRAM 104 are expanded and decoded by the image decoding section 129*a* of the image coding/decoding section 129, and developed in the internal SRAM 129*c* as the image data. The developed image data has the correction and the image converting processing performed thereon by the recording image processing section 114, and is printed and output onto a recording paper by the printer engine 116 based on the control of the printer controlling microcomputer 115.

(Facsimile Receiving Operation)

At the time of receiving an incoming message, the received data are input into the communication controlling section 123 through the communication connecting section 122. The facsimile communication procedure signal is transmitted and received, and then the image data reception is started. The image data are demodulated by the communication controlling section 123 so as to be transmitted to the receiving buffer of the DRAM 104 by each 1 bit based on the control of the MPU 101 according to the input interruption signal from the communication controlling section 123. The received data transmitted to the receiving buffer are stretched and decoded by the image decoding section 129*a* of the image coding/decoding section 129 for examining the image error, and then developed as the image data in the internal SRAM 129*c*. The developed image data has the correction and the image converting processing performed by the recording image processing section 114, and is printed and output onto a recording paper by the printer engine 116 based on the control of the printer controlling microcomputer 115.

(Printer Operation)

The command and the receiving parameters are sent out by each 1 bit from the information processing terminal 131 to the external interface 127. The command and the receiving parameters received by the external interface 127 are transmitted to the receiving buffer of the DRAM 104 by each 1 bit based on the control of the MPU 101 according to the input interruption signal from the external interface 127. The command stores a command code for identifying each command, the size of the subsequent receiving parameter, or the like, and in the receiving parameter, a setting value and the image data necessary for executing the operations for each command are stored. The receiving parameter excluding the command and the image data transmitted to the receiving buffer is processed by the MPU 101.

Here, in the case the content of the receiving parameter is the image data, the coding data having the image data or the raw data are expanded and decoded by the image decoding section 129*a* of the image coding/decoding section 129 according to the image data system information represented by the preliminarily received receiving parameter, and developed as the image data in the internal SRAM 129*c*. The developed image data are compressed and coded by the image coding section 129*b* of the image coding/decoding section 129 so as to be accumulated in the DRAM 104, and the image data administration information is stored in the DRAM 104. The developed image data are printed and output onto a recording paper S by the printer engine 116 based on the control of the printer controlling microcomputer 115. After receiving the command, the response and the sending parameter corresponding to the command are produced and sent out.

The responses include an OK response representing the reception of the received command, an NG response representing the failure of the reception due to the wrong received command, and a BUSY response representing the current impossibility of receiving the received command due to the operation, or the like. Moreover, the sending parameter stores the transmission and printing results, the attributions of the file and the page, the apparatus information corresponding to the designated command, the pause command, the resending command, or the like. The response is set in the transmission buffer of the DRAM 104 by the MPU 101, transmitted to the external interface 127 by each 1 bit based on the control of the MPU 101 according to the input interruption signal from the external interface 127, and sent out to the information processing terminal 131.

(Memory Card Operation)

The memory card interface 132 waits until the memory card 133 is connected. In the case the memory card 133 is connected, it is operated with reference to the internal data as shown below according to the setting mode.

<Direct Recording Mode>

In the case the apparatus is set in the direct recording mode, the image data file in the memory card 133 (for example, the image data file of the JPEG format) is retrieved according to a predetermined rule. Next, a predetermined administration number is set for the retrieved and extracted image data. Thereafter, according to the operation input of the operating portion 118, it is developed based on the control of the MPU 101 so as to have a predetermined size so as to be printed and output onto the recording paper S by the printer engine 116 based on the control of the printer controlling microcomputer 115. The image data to be output are a list or a single image of the extracted image data file.

<Memory Card Reader Writer Mode>

In the case the apparatus is set in the memory card reader writer mode, it is operated so as to transfer the data file in the memory card 133 according to the command from the information processing terminal 131 or write the data file input from the information processing terminal 131 in the memory card 133. The MPU 101 communicates with the information processing terminal 131 according to a predetermined controlling command so as to control taking out or writing the data file for the memory card 133 with respect to the memory card interface 132.

As the image recording apparatus in this embodiment, those connected with the CPU as the controlling means (to be described later), for transferring the image recording data produced in the CPU for recording an image, can be used. However, the image recording apparatus of the present invention is not limited thereto, and, for example, one recording an image after reading the recording image, such as a copying machine, can be included.

{Taking Out the Recording Head}

Figure 4:
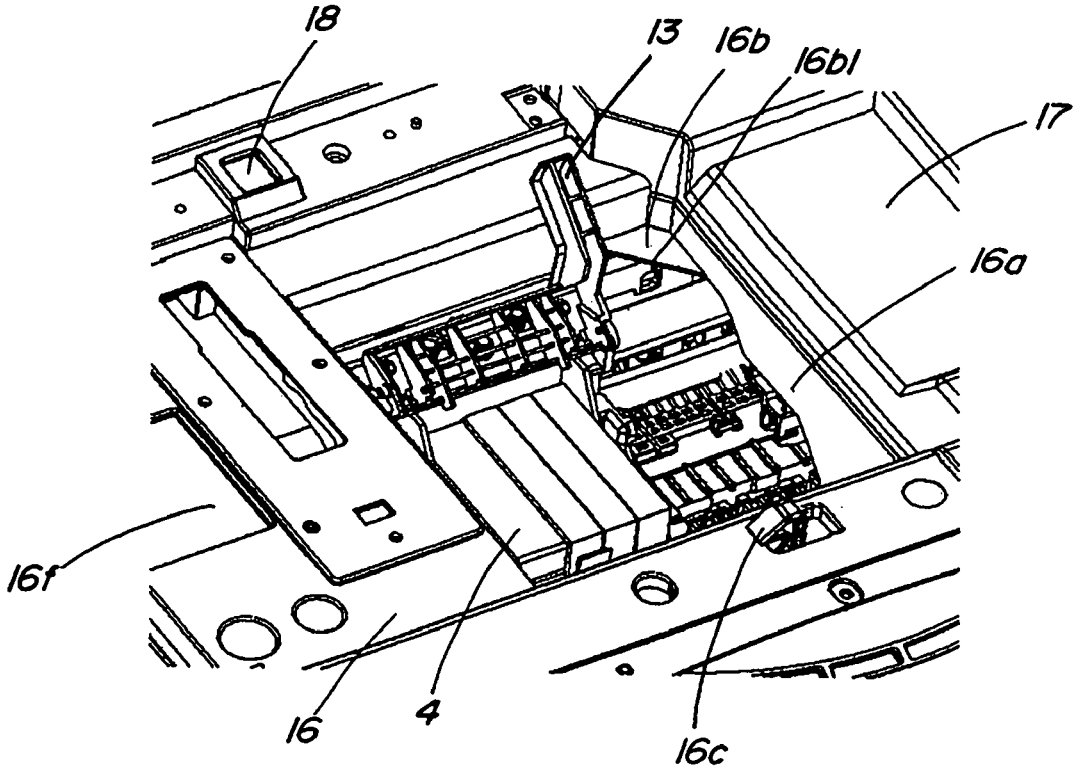
FIG. 4 is an explanatory view of the vicinity of a recording head and a replacement opening portion of an ink tank.
Figure 5:
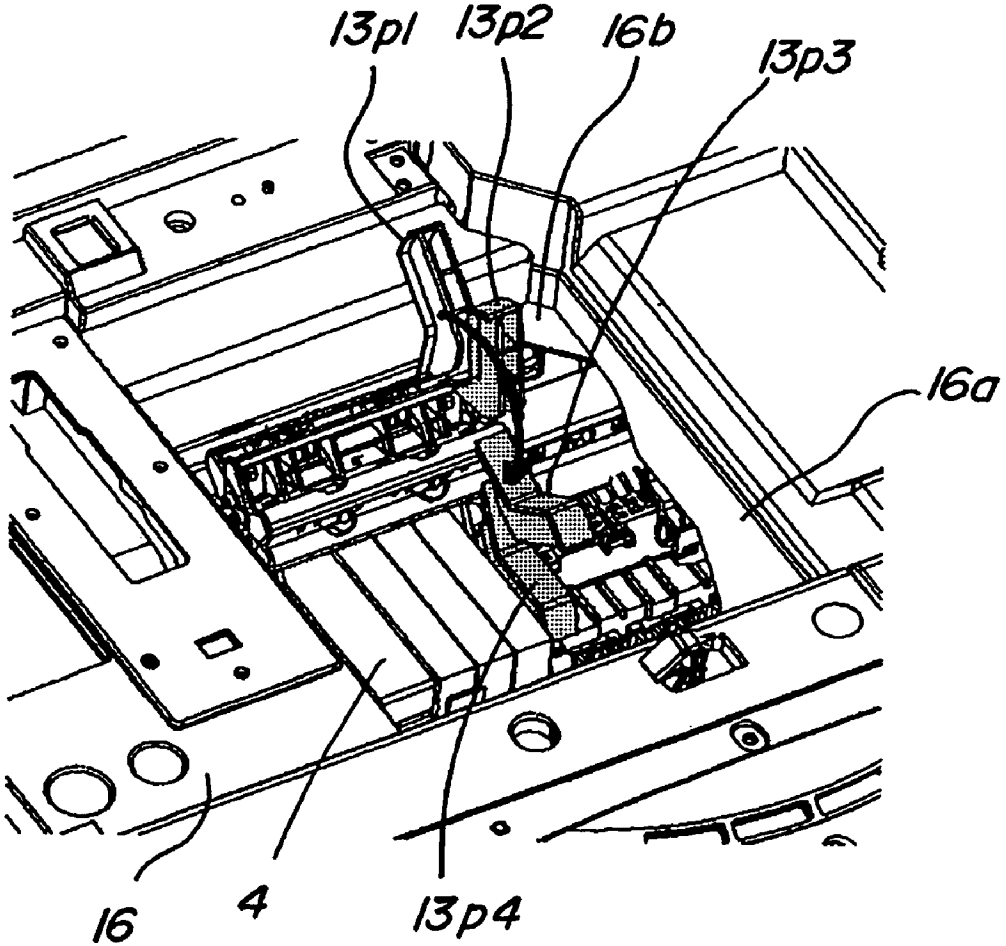
FIG. 5 is an explanatory view of the vicinity of a recording head and a replacement opening portion of an ink tank.
Figure 6:
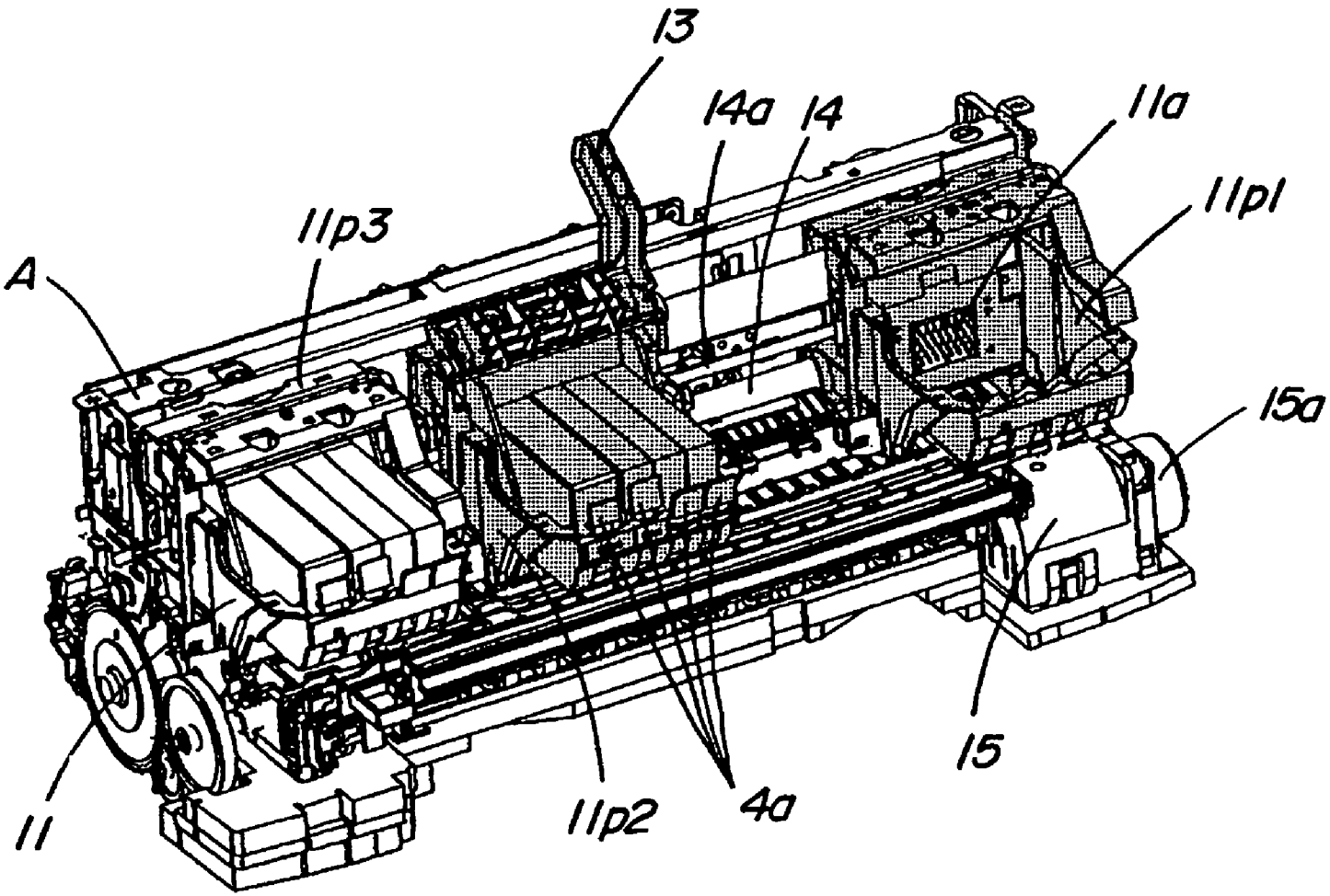
FIG. 6 is an internal explanatory view of a recording section.
Figure 7:
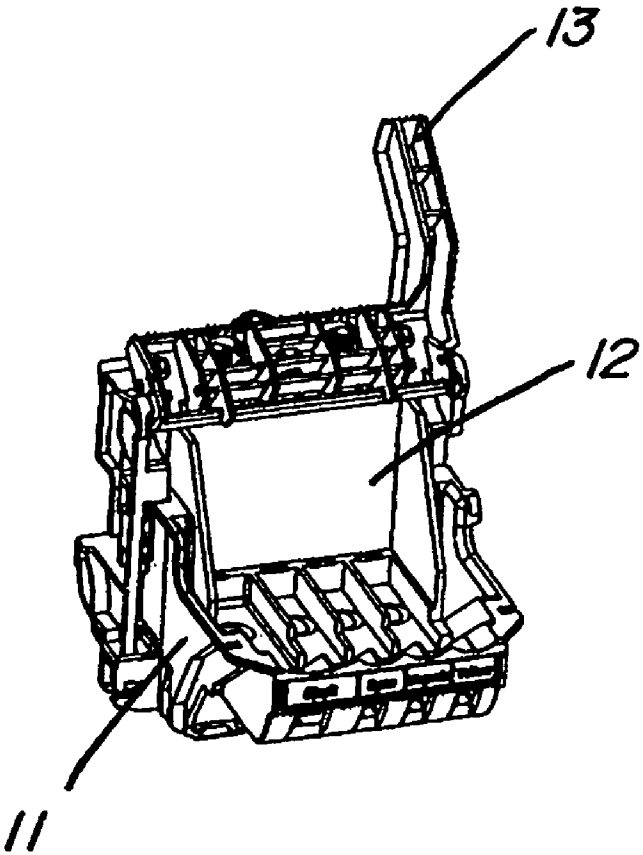
FIGS. 7(*a*) and (*b*) are explanatory views of a carriage portion.
Figure 7:
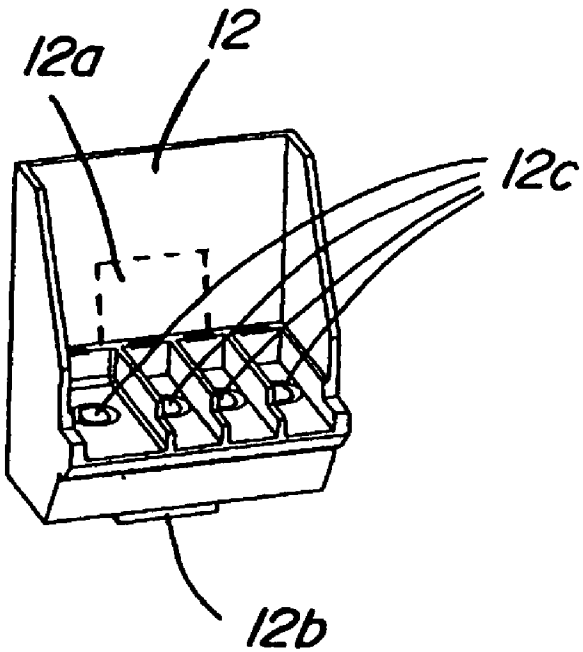
Figure 8:
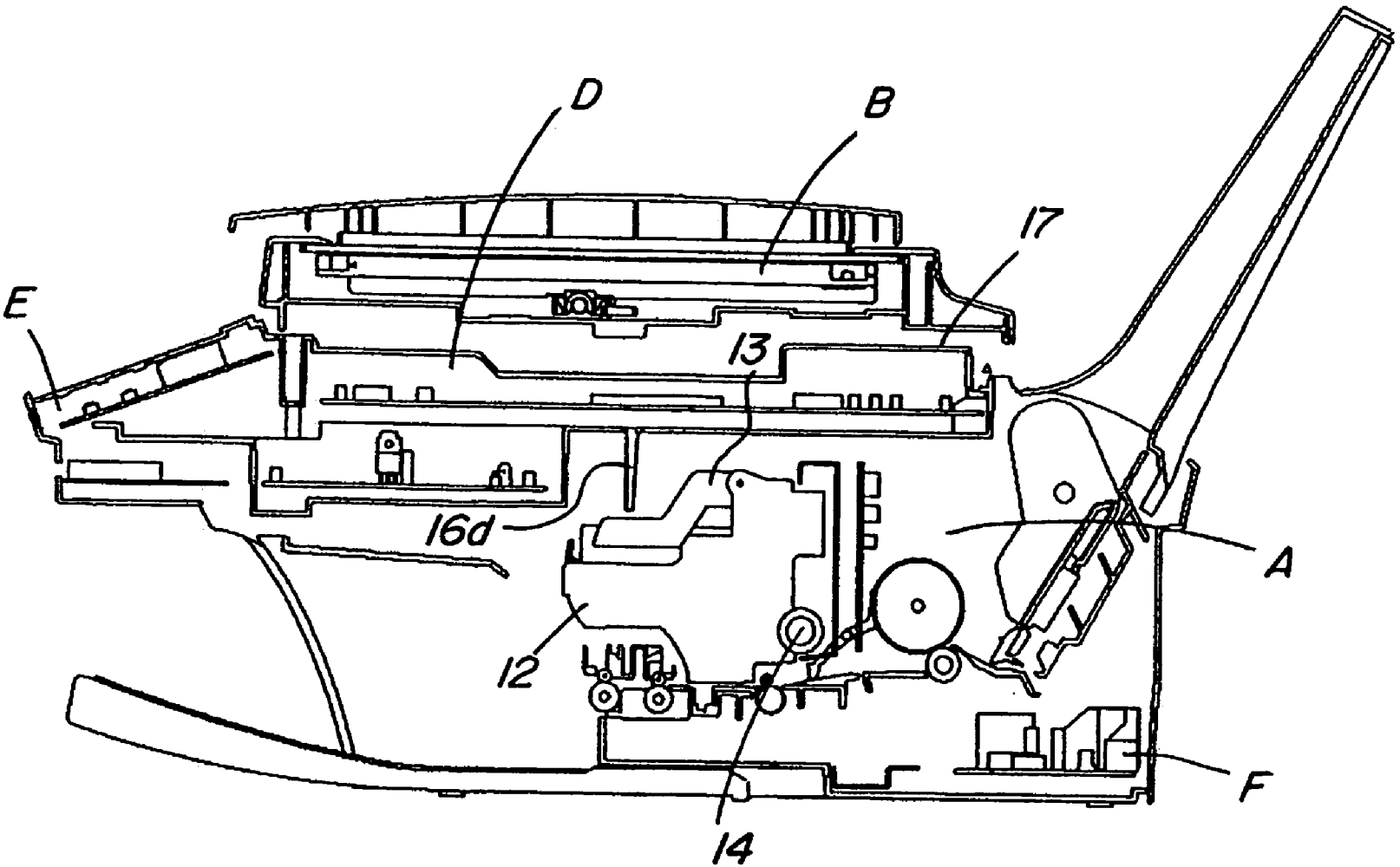
FIG. 8 is a perspective view of the controlling section position of the apparatus viewed from the right side.
Figure 9:
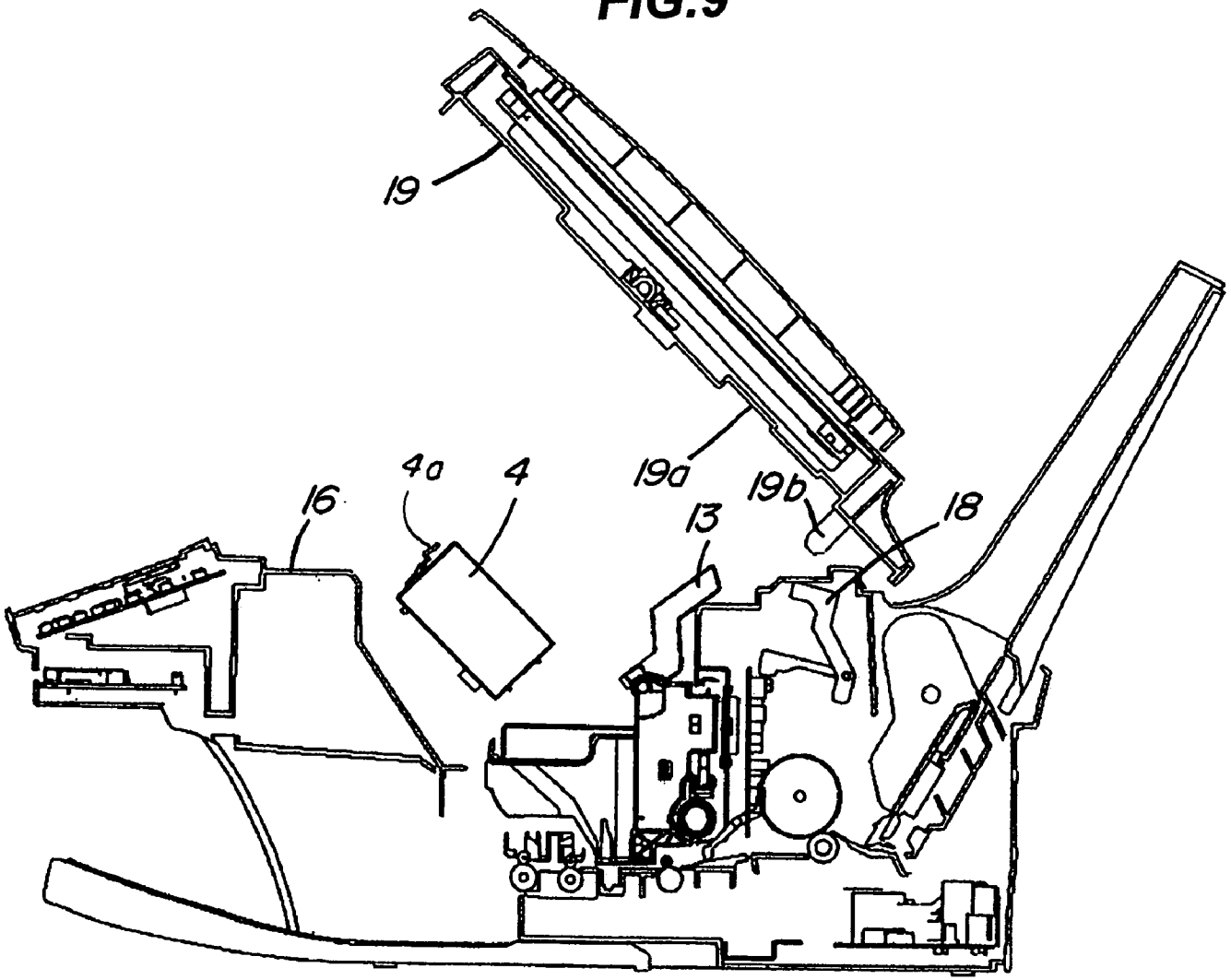
FIG. 9 is a perspective view of the substantially central portion of the apparatus viewed from the right side.
Figure 10:
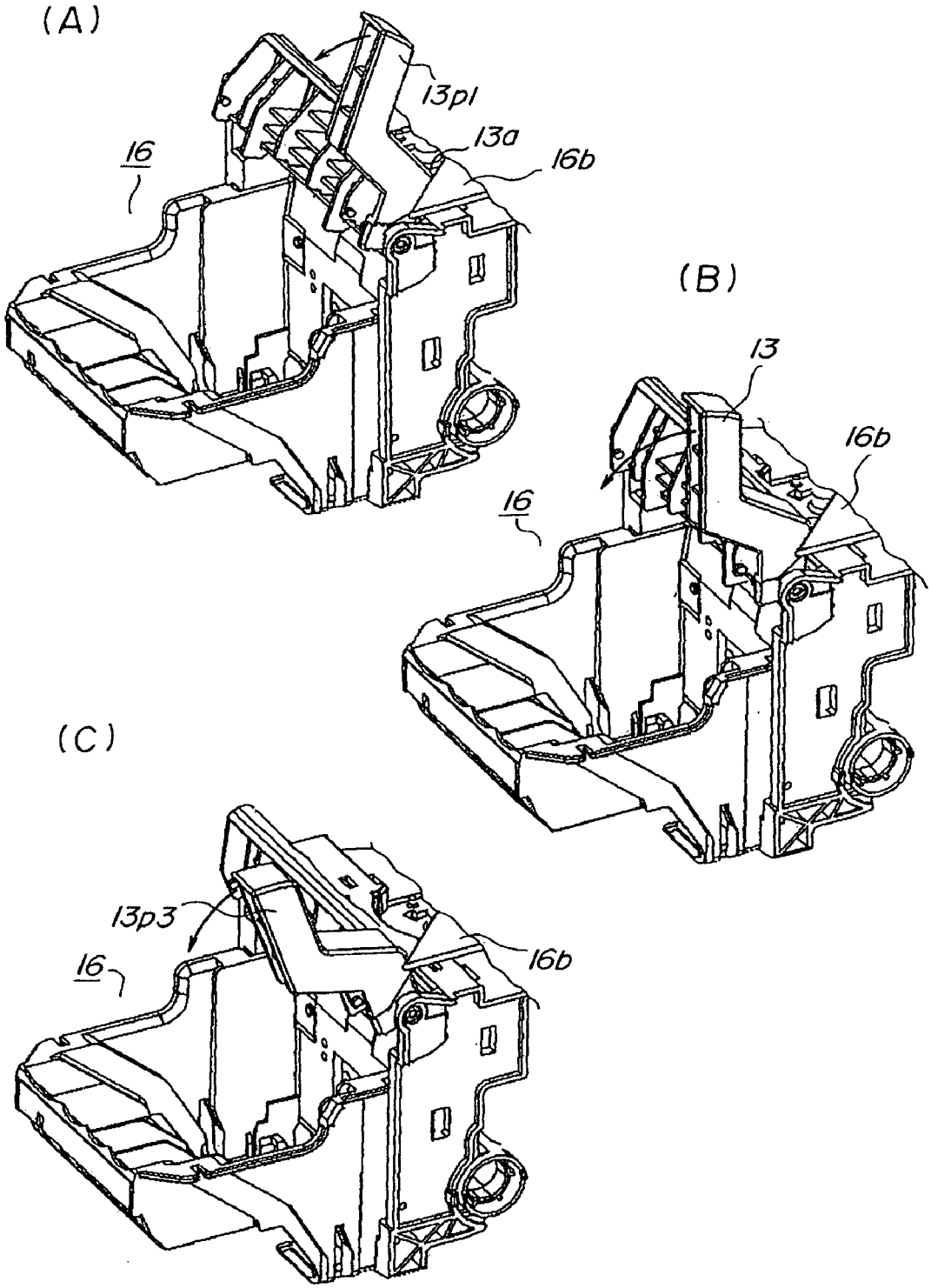
FIGS. 10(A) to (C) are operation explanatory views of a release lever.
Figure 11:
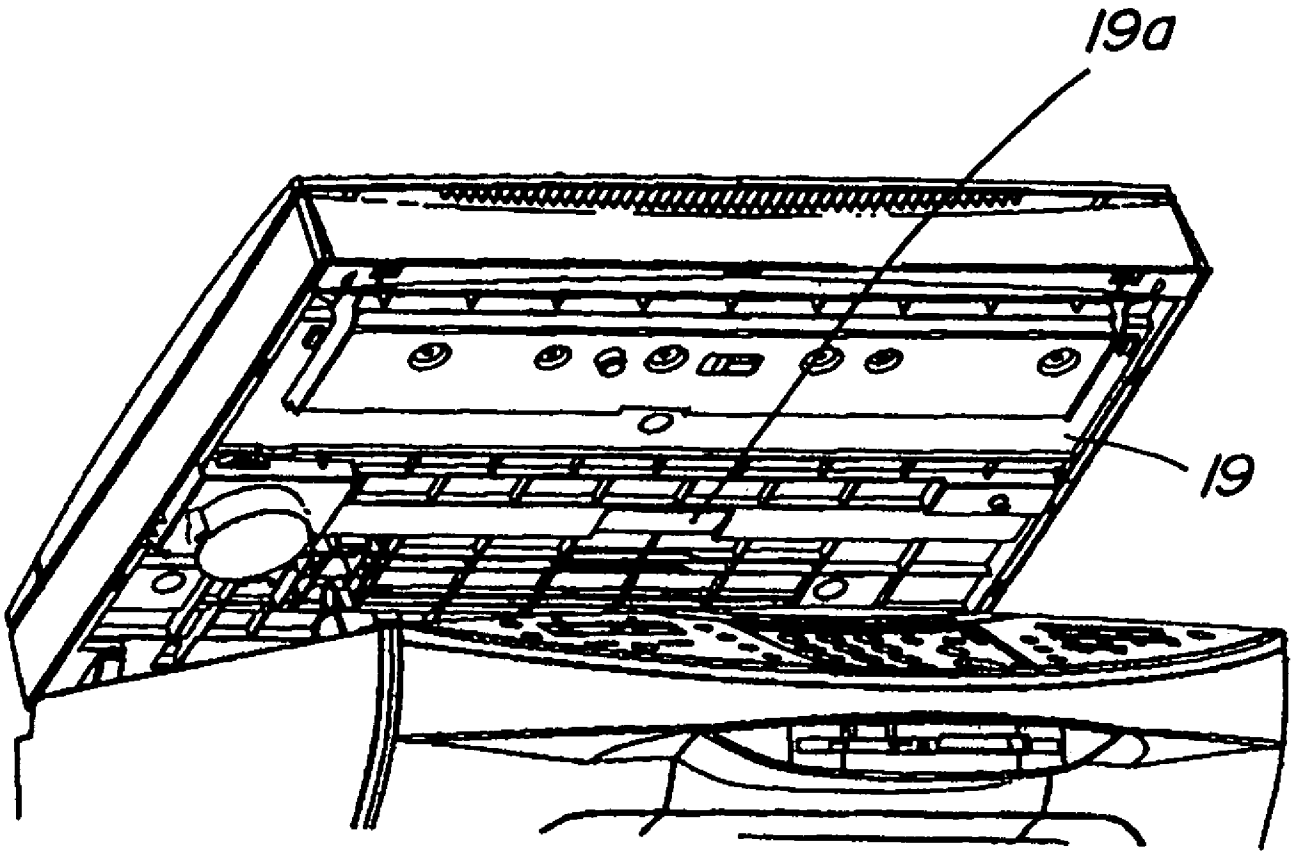
FIG. 11 is a view of a reading section viewed from the obliquely downward side.

Next, with reference to FIGS. 4 to 11, the recording head taking out operation will be explained. FIGS. 4 and 5 are explanatory views of the vicinity of the recording head and the replacement opening portion of the ink tank 4. FIG. 6 is an internal explanatory view of the recording section A. FIGS. 7(*a*) and (*b*) are explanatory views of the carriage portion. FIG. 8 is a perspective view of the controlling section D position of the apparatus viewed from the right side. FIG. 9 is a perspective view of the substantially central portion of the apparatus viewed from the right side. FIGS. 10(A) to (C) are operation explanatory views of the release lever. FIG. 11 is a view of the reading section B viewed from the obliquely downward side.

In FIGS. 4 to 11, the reference numeral 11 is a carriage, 11*a* is a contact portion with respect to the recording head, 11*p*1 is the state with the carriage 11 disposed at the standby position (first stopping position), 11*p*2 is the state with the carriage 11 disposed at the head replacing position (second stopping position), and 11*p*3 is the state with the carriage 11 moved maximally to the side opposite to the standby position 11*p*1.

The reference numeral 12 is a recording head having the recording means, 12*a* is the contact portion with the carriage provided on the rear side of the recording head 12, 12*b* is an ink ejecting section, and 12*c* is an ink supplying section for taking in the ink from the ink tank 4.

The reference numeral 13 is a release lever as the lever member for fixing or releasing the recording head, 13*a* is the contact position for moving the release lever 13, 13*p*1 to 13*p*4 show the postures of the release lever 13, that is, 13*p*1 is the releasing posture for releasing the recording head 12, and 13*p*4 is the fixing posture for fixing the recording head 12.

The reference numeral 14 is a guide shaft for guiding the movement of the carriage 11, and 14*a* is a code strip for a linear encoder disposed substantially parallel with the guide shaft 14.

The reference numeral 15 is a pump unit. The pump unit 15 is for generating negative pressure by an unshown pump by rotating the pump motor 15*a* in the forward direction with the carriage 11 disposed at the standby position 111*p* for supplying the ink from the ink tank 4 to the recording head 12 or eliminating the unnecessary ink adhered on the ink ejecting section 12*b*. Moreover, by rotating the pump motor 15*a* by a predetermined amount in the backward direction, it projects an unshown lock bolt in the carriage 11 moving area and supports the carriage 11 without movement even in the case the power source is turned off (carriage lock).

The reference numeral 16 is a middle frame for covering the upper portion of the recording section A, 16*a* is an opening portion inner wall of the middle frame 16, 16*b* is a release lever rotating guide rib as the lever guide member provided to the opening portion inner wall 16*a*, 16*c* is a scanner fixing lever, 16*d* is a release lever limiting rib as the limiting member, and 16*e* is an opening portion wall lower end portion.

The reference numeral 17 is a system control substrate cover, 18 is a scanner switching sensor section, 19 is a scanner base for forming the housing lower portion of the reading section B as the cover member, 19*a* is a recess portion provided in the scanner base 19, and 19*b* is a switching and detecting section provided on the scanner base 19.

{Recording Head Replacement}

Next, the recording head replacement will be explained. In the case an unshown scanner release button of the apparatus is pressed, the scanner fixing lever 16*c* is pressed by an unshown release bar and operated so that the reading section B covering the recording section A is opened.

The reading section B opening operation is detected by the controlling section by the separation of the switching and detecting section 19*b* from the scanner switching sensor section 18. In the case the reading section B is opened, the controlling section moves the carriage 11 from the stand by position 11*p*1 to a predetermined maintenance position 11*p*2 provided at the opening portion by operating an unshown CR motor.

In this state, the operator can replace the ink tank 4 by operating the release tab 4*a* of the ink tank 4. Moreover, by rotating the release lever 13 upward in a state with the ink tank 4 detached, and changing from the fixing posture 13*p*4 for fixing the recording head 12 to the releasing posture 13*p*1 as shown in FIG. 5, the recording head 12 is released so that it can be detached from the carriage 11. The release lever 13 maintains the releasing posture 13*p*1 according to its own weight balance. Moreover, by projecting the top end of the release lever 13 upward from the opening portion inner wall 16*a* of the middle frame 16 at the releasing posture 13*p*1, the release lever 13 can be grasped easily at the time of closing the release lever 13 by the operator.

In the case the operator moves the release lever 13 to the fixing posture 13*p*4 with the recording head 12 mounted on the carriage 11, the contact portion 12*a* of the recording head 12 (see FIGS. 7(*a*) and (*b*)) is pressed against the contact portion 11*a* on the carriage 11 side (see FIG. 6) so that the apparatus main body detects the recording head 12 mounting operation. In the case the reading section B is closed in this state, the controlling section moves the carriage 11 to the standby position 11*p*1 with the reading section B closing detection of the scanner switching sensor section 18 used as the trigger. Furthermore, after passage of a predetermined time, the controlling section executes the carriage lock by the above-mentioned operation.

Next, the case with the recording head 12 left by the operator in a state taken out from the carriage 11 will be explained. In the case a predetermined time has passed in the state with the release lever 13 disposed at the releasing posture 13*p*1, the operating portion moves the carriage 11 from the maintenance position 11*p*2 toward the standby position 11*p*1. As shown in FIGS. 10(A) to (C), according to the movement, the contact position 13*a* for moving the release lever 13 is contacted with the release lever rotating guide rib 16*b* provided on the opening portion inner wall 16*a*. Although the release lever 13 is rotated in the vertical direction as mentioned above, the release lever rotating guide rib 16*b* has an inclined side 16*b*1 crossing with respect to the rotation surface of the release lever 13 for rotating the lever member downward according to the movement of the carriage (see FIG. 4). That is, since the release lever rotating guide rib 16*b* is provided with the inclined side 16*b*1 for moving the release lever 13 to the fixing posture 13*p*4 (see FIG. 5), the release lever 13 is rotated gradually to the fixing posture 13*p*4 according to the movement of the carriage 11, and finally it is moved to the fixing posture 13*p*4 position according to its own weight balance. FIGS. 10(A) to (C) and FIG. 5 show the state of the release lever 13 rotation successively.

Although the final portion of the movement of the release lever 13 to the fixing posture 13*p*4 position according to the movement of the carriage 11 is by the weight balance of the release lever 13 in this embodiment, it is not limited thereto, and, for example, it may be guided by the release lever rotating guide rib 16*b* to the fixing posture 13*p*4 position. In this case, since it can be moved to the fixing posture 13*p*4 forcibly even in the state with the recording head 12 mounted on the carriage 11, the recording head 12 can be fixed automatically by the release lever 13.

In the case the carriage 11 is further moved, as shown in FIGS. 10(A) to (C), the release lever 13 is moved below the opening portion inner wall lower end portion 16*e* of the middle frame. Since the upward rotation of the release lever 13 is limited by the release lever limiting rib 16*d* provided in the middle frame 16 from this position to the standby position 11*p*1, even in the case the posture of the apparatus is changed, the movement of the release lever 13 above the opening portion inner wall lower end portion 16*e* can be prevented so that the trouble of the movement of the carriage 11 derived from hooking of the release lever 13 by the opening portion inner wall lower end portion 16*e* can be prevented. Since the release lever limiting rib 16*d* is provided also to the lower portion of the left side 16*f* of the middle frame 16 opening portion (see FIG. 4), the upward rotation of the release lever 13 can be limited also in the case the carriage 111 is disposed in the vicinity of the state 11*p*3 with the carriage 11 moved maximally to the side opposite to the standby position 11*p*1.

Next, the case with the power source blocked in a state with the release lever 13 disposed at the releasing posture 13*p*1 will be explained. As mentioned above, the release lever 13 is in the releasing posture 13*p*1 state in the case the carriage 11 is in the range of the opening portion inner wall 16*a*. In the case the power source is blocked in this state, the apparatus cannot move the carriage 11 to the standby position 11*p*1. Moreover, since the carriage 11 can be moved by the transportation, or the like, in the power source blocked state, the present position of the carriage 11 should be recognized accurately again. In this embodiment, the present position of the carriage 11 is recognized by reading and counting the pattern on the code strip 14*a* by an unshown sensor on the carriage 11 while moving. Since the present position of the carriage 11 is always grasped by the position from a reference point accordingly, the controlling section is controlled so as to be moved first always to the standby position 11*p*1 as the reference point on the carriage 11 at the time of turning on the power source. Therefore, since the release lever 13 is moved to the fixing posture 13*p*4 position even in the case the power source is turned on with the release lever 13 disposed at the releasing posture 13*p*1 state, the trouble is not caused to the movement of the carriage 11.

Furthermore, even in the case the reading section B is closed with the release lever 13 disposed in the releasing posture 13*p*1 state, as shown in FIGS. 9 and 11, the release lever 13 top end enters into the recess portion 19*a* provided in the scanner base 19 so that the release lever 13 is not contacted with the scanner base 19. Moreover, since the recess portion 19*a* covers the range without disturbing the movement of the release lever 13 even in the state with the reading section B closed, it can be moved without problem to the standby position 11*p*1 on the carriage 11 regardless of the reading section B switching state.

{Other Embodiments}

Although the ink tank 4 and the recording head 12 are explained as the individual members of the recording means in the above-mentioned embodiment, it is not limited thereto. For example, any configuration of the recording means, such as a cartridge type with the recording head and the ink tank provided integrally, can be used similarly, and the same effect can be achieved. Moreover, the release lever is not limited to one, and, for example, a plurality of the release levers may be used.

Moreover, although the case of the ink jet recording apparatus using one recording head is explained in the above-mentioned embodiment, the present invention is not limited thereto, and, for example, an ink jet recording apparatus using a plurality of recording heads for each different color can be used as well so that it can be applied in the same manner regardless of the number of the recording heads and the same operation effect can be achieved.

In the case the present invention is applied for the ink jet recording apparatus, for example, although it can be used for the recording means using an electromechanical converter such as a piezoelectric element, in particular, an excellent effect can be brought about in the ink jet recording apparatus using recording means of the method for ejecting the ink using thermal energy. According to the method, high density and high quality recording can be achieved.

Furthermore, as to the form of the above-mentioned recording unit, in addition to the one used as the image outputting terminal unit of the information processing appliance such as a computer, a copying machine, or the like as a combination of an inputting and outputting unit capable of mounting a scanner, or the like other than the recording head on the carriage, a reader, or the like may be used as well.

The invention claimed is:

1. A recording apparatus comprising:

a carriage provided reciprocally movably with recording means placed thereon;

a switchable cover member for covering an opening portion for taking the recording means out from the apparatus at a time said carriage is stopped at a second stopping position different from a first stopping position provided at one end of a reciprocal movement range; and a lever member provided movably to a first position for fixing the recording means on the carriage or a second position for releasing the recording means therefrom, wherein at said time the carriage is moved to the first stopping position, said lever member is moved from the second position for releasing the recording means from said carriage to the first position for fixing the recording means on said carriage.

2. The recording apparatus according to claim 1, wherein said lever member is moved by contacting said lever member with a lever guide member provided at the opening portion.

3. The recording apparatus according to claim 2, wherein said lever guide member has an inclined side crossing with respect to a rotation surface of said lever member for rotating said lever member in a predetermined direction according to the movement of said carriage.

4. The recording apparatus according to claim 2, wherein a position for starting contact of said lever guide member with said lever member is provided between the first stopping position and the second stopping position.

5. The recording apparatus according to claim 4, wherein a limiting member is provided in said lever guide member at a position between the position for starting the contact of said lever member with said lever guide member and the first stopping position for limiting the movement of said lever member to the second position for releasing the recording means from said carriage.

6. The recording apparatus according to claim 1 or 2, wherein the lever member movement is enabled also in a state with said cover member closed.

7. The recording apparatus according to claim 1, wherein a first carriage movement at the time a power source of the apparatus is turned on is always in a direction toward the first stopping position.

8. The recording apparatus according to claim 1, wherein a reading section having reading means for reading original information is disposed substantially above the recording means, and the reading section serves also as said cover member.

9. The recording apparatus according to claim 1, wherein the recording means comprises a recording head for recording input image information by ejecting ink droplets onto a recording medium, and an ink cartridge for supplying the ink to the recording head.

10. The recording apparatus according to claim 1, wherein the recording means comprises a recording head unit holding a plurality of recording heads corresponding to a plurality of colors for recording input image information by ejecting ink droplets onto the recording medium, and an ink cartridge comprising a plurality of ink tanks for supplying ink to each of the plurality of the recording heads.

* * * * *

UNITED STATES PATENT AND TRADEMARK OFFICE

CERTIFICATE OF CORRECTION

PATENT NO. : 7,066,569 B2
APPLICATION NO. : 10/764546
DATED : June 27, 2006
INVENTOR(S) : Ishizuka et al.

It is certified that error appears in the above-identified patent and that said Letters Patent is hereby corrected as shown below:

TITLE PAGE AT ITEM [56] REFERENCES CITED:
Foreign Patent Documents, "06270491" should read --06-270491--; and "08207392" should read --08-207392--.

COLUMN 8:
Line 44, "position 111*p*" should read --position 11*p*1--.

COLUMN 10:
Line 24, "carriage 111" should read --carriage 11--.

Signed and Sealed this

Twenty-ninth Day of April, 2008

JON W. DUDAS
*Director of the United States Patent and Trademark Office*